United States Patent [19]

Dulaquais

[11] 4,111,029

[45] Sep. 5, 1978

[54] MANUFACTURE OF PIPE STUBS IN WALLS OF VERY GREAT THICKNESS

[75] Inventor: Pierre Dulaquais, Montcenis, France

[73] Assignee: Creusot-Loire, Paris, France

[21] Appl. No.: 698,206

[22] Filed: Jun. 21, 1976

[30] Foreign Application Priority Data

Jan. 9, 1976 [FR] France ..... 76 00471

[51] Int. Cl.[2] ..... B21D 51/38

[52] U.S. Cl. ..... 72/342; 72/358

[58] Field of Search ..... 72/341, 325, 326, 327, 72/332, 333, 342, 359, 358; 29/157.4

[56] References Cited

U.S. PATENT DOCUMENTS

| | | | |
|---|---|---|---|
| 1,675,910 | 7/1928 | Riker | 72/325 |
| 2,157,354 | 5/1939 | Sherman | 72/379 X |
| 2,859,510 | 11/1958 | Baxa | 29/157.4 |
| 3,022,811 | 2/1962 | Huet | 29/157.4 X |

FOREIGN PATENT DOCUMENTS

| | | | |
|---|---|---|---|
| 1,034,125 | 7/1958 | Fed. Rep. of Germany | 72/342 |

*Primary Examiner*—Lowell A. Larson

*Attorney, Agent, or Firm*—Haseltine, Lake, & Waters

[57] ABSTRACT

A pipe stub is formed in a wall of great thickness by first machining an aperture in the wall and then deforming the material of the wall surrounding the aperture to form the pipe stub, the deformation being carried out after heating the material and using a punch and anvil which are shaped to produce a progressive deformation of the material.

7 Claims, 6 Drawing Figures

MANUFACTURE OF PIPE STUBS IN WALLS OF VERY GREAT THICKNESS

FIELD OF THE INVENTION

The present invention relates to the manufacture of pipe stubs in walls of very great thickness which constitute parts of chambers under pressure.

The invention is particularly applicable to the production of constituent elements of pipe-carrier collars used in nuclear reactors, steam generators, and chemical reactors employed in hydrocracking, hydrosulphuration, and synthesis, etc., techniques and the like.

BACKGROUND

In nuclear reactors, especially pressurized water and boiling water reactors, the reactor core is located inside a closed chamber which constitutes a tank in which fluid which is intended to cool the core and supply energy is heated. This fluid is exhausted and passed to steam generators through pipes the ends of which are attached to pipe stubs on the tank. The same goes for the pipes which bring the cooled fluid back into the tank. In view of the pressures to be withstood, the tank normally consists of superimposed collars of very thick plate. The collars may be obtained by forging from a single annular piece or by welding a number of "plastrons" of curved plate each constituting a segment of a cylinder.

In the same way pipe stubs must be provided on the steam generator and especially on the ends of these generators which often are shaped as a segment of a sphere.

The ends and the collar furnished with pipe stubs are manufactured in two main ways.

Firstly, one can make a casting in one piece. It is then sufficient to provide a pipe stub in the mould. The casting, however, is objected to by users for various reasons and its dimensions are always limited.

An end or collar may likewise be produced in the form of stamped pieces of plate in which apertures have been provided, the diameter of which is equal to the maximum diameter of the pipe stub. The pipe stub then consists of special cast or forged pieces which are welded on to the plate along the edge of the aperture.

The machining of the apertures, production of welds in very thick walls under difficult conditions, especially when the weld must be curved, and the numerous checks necessary increase the cost of manufacture very substantially. On the other hand, for safety reasons it is necessary to check regularly the hold of the welds, which necessitates stopping the operation of the plant including a chamber produced in this way.

SUMMARY OF THE INVENTION

It is an object of the invention to provide a method of manufacture of a pipe stub in a wall of very great thickness which constitutes part of a chamber to be placed under pressure, the method comprising machining an aperture, centered on the axis of the pipe stub to be obtained, in said thick wall, applying said wall to, and centering said aperture on, a tubular anvil having a central passage coaxial with said aperture and the diameter of which corresponds substantially with the outer diameter of the pipe stub to be obtained and the cross-section of which increases progressively up to a rounded bearing surface, the shape of which corresponds with that of the wall at the root of the pipe stub to be made, heating said wall at least over the portion surrounding said aperture, and deforming said wall by means of a punch which is caused to penetrate by force into said aperture, said punch being displaced along the axis of the aperture and having a cross-section which increases progressively from a centering tip of diameter less than that of said aperture to a diameter at least equal to the internal diameter of the pipe stub to be obtained.

It is another object of the invention to provide apparatus for the manufacture of a pipe stub in a wall of very great thickness which constitutes part of a chamber to be placed under pressure, the apparatus comprising a press having a tubular anvil provided with a central passage the diameter of which corresponds substantially with the outer diameter of the pipe stub to be obtained and the cross-section of which increases progressively up to a rounded bearing surface the shape of which corresponds with that of the wall at the root of the pipe stub to be made, and a punch provided at its end with a centering tip for entering an aperture preformed in the wall on the axis of the pipe stub, the cross-section of the punch increasing progressively up to a diameter at least equal to the internal diameter of the pipe stub.

BRIEF DESCRIPTION OF THE DRAWINGS

The invention will now be described by reference to embodiments thereof, given by way of example only, with reference to the accompanying drawings.

In the drawings.

DETAILED DESCRIPTION

Figure 1:
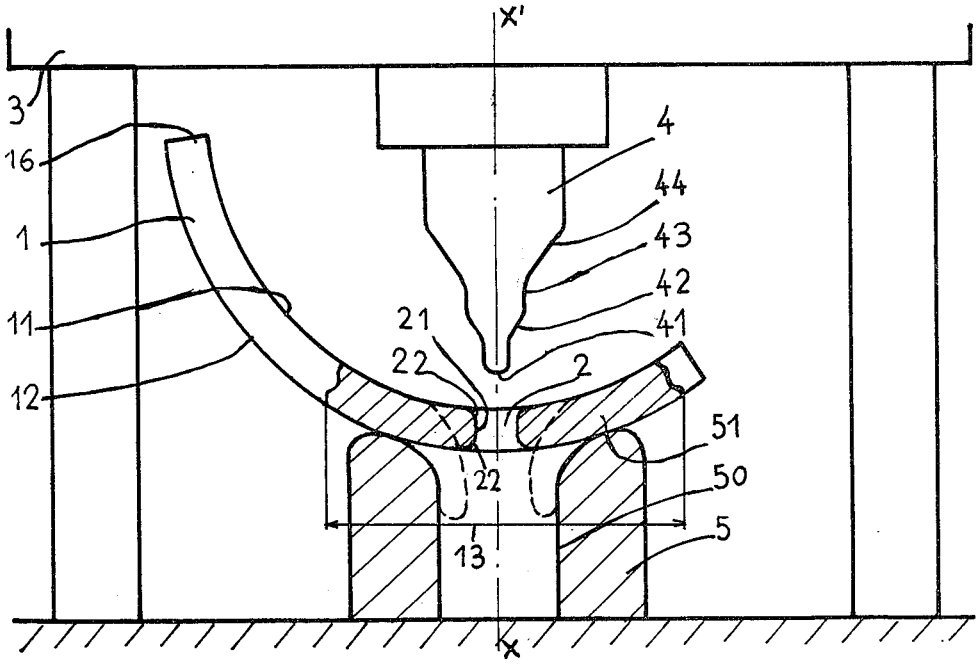
FIG. 1 shows diagrammtically an embodiment of apparatus according to the invention.

In FIG. 1 there is shown diagrammatically a wall 1 in which a pipe stub is to be formed. In the example illustrated this wall is a plate in the shape of a segment of a cylinder or a segment of a sphere.

On the axis of the pipe stub which is to be obtained an aperture 2 is first produced by machining, the diameter of which may be, for example, of the order of the thickness of the wall. The surface 21 of the cylindrical aperture is connected to the inner face 11 and outer face 12 of the wall by rounded edges 22.

Figure 2:
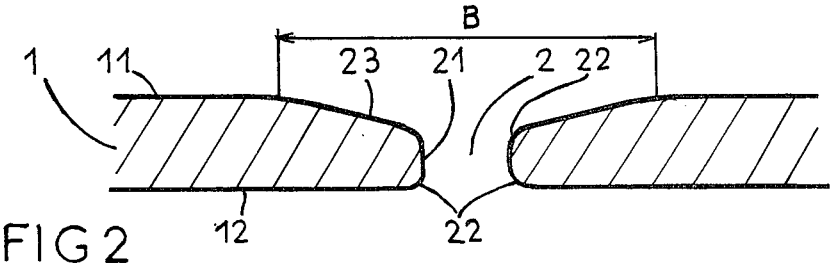
FIG. 2 and FIG. 3 are details on an enlarged scale, of a wall before and after respectively the forming of the pipe stub.

As shown in FIG. 2, it may be advantageous to extend the aperture 2 towards the inside of the wall by a dish 23 in the shape of a very flattened cone the base B of which has a diameter slightly less than that of the base of the pipe stub which is to be obtained. The conical surface of the dish is connected by rounded edges to the inner face 11 of the wall 1 and the cylindrical face 21 of the aperture 2.

Of course, if the wall 1 is obtained from a curved plate the orifice may be machined in the plate in the flat before curving it.

The wall 1, machined as described above, is put on the axis of a press 3 including a vertically movable punch 4 and an anvil 5.

The anvil 5 is tubular and has a central cylindrical passage 50, the diameter of which corresponds substantially with the outer diameter of the pipe stub which is to be obtained. The cross-section of the passage 50 progressively widens out upwardly to the top portion of the anvil 5 which forms a rounded bearing surface 51 the shape of which corresponds with that of the wall of the root of the pipe stub. Thus, if the wall 1 is a segment of a sphere, the bearing surface 51 will have a circular shape but it will have to be inwardly curved if the wall 1 is cylindrical.

In general, the internal surface of the tubular anvil 5 has a shape which corresponds substantially with that of the outer surface of the pipe stub which is to be obtained.

The punch 4 has a special shape. It comprises at its bottom end a substantially cylindrical centering tip 41 the diameter of which is slightly less than that of the aperture 2. This centering tip is followed by a first conical surface 42 widening upwards, which is connected progressively to a cylindrical portion 43 the diameter of which is substantially equal to the internal diameter of the pipe stub which is to be obtained and which in turn is followed by a second conical surface 44 which widens out upwards.

In accordance with the invention, the press 3 causes the punch 4 to penetrate with force into the aperture 2.

The wall 1 is heated beforehand, at least over the portion 13 surrounding the aperture, to a temperature enabling the transformation point A1 to be clearly exceeded, but remaining below the normal forgoing temperatures which correspond with deformation by rapid flow. This temperature may be, for example, about 1000° C and enables oxidation and tearing to be avoided.

When the punch 4 descends vertically the tip 41 penetrates first into the aperture 2 and ensures centering of the punch along the axis *xx'* of the aperture, essentially at the start of the deformation.

Figure 3:
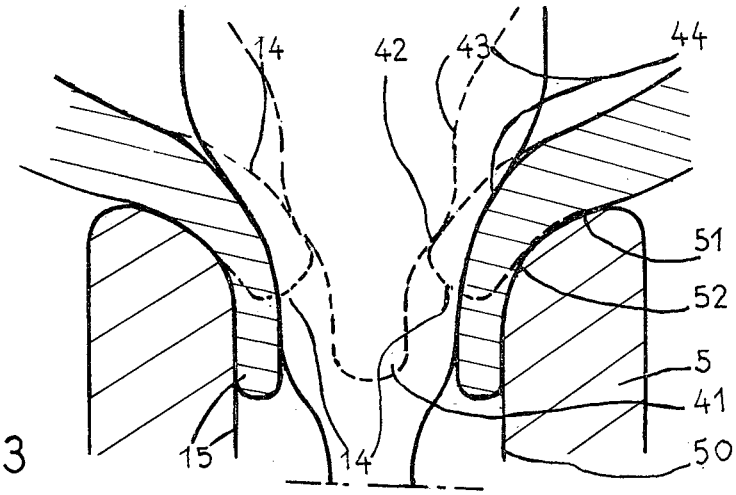

Penetration of the conical surface 42 into the aperture 2 causes the edges of the aperture to be spread apart downwards so that the cross-section of the aperture enlarges and the wall thickness is reduced, as shown at 14 in dotted line in FIG. 3. As the aperture enlarges, the thickness of the wall diminishes.

The upper end of the substantially conical surface 42 is rounded to become convex in its connection to the cylindrical portion 43. During the course of this first transformation the portion 14 of the plate is applied against the widened surface 52 of the anvil 5. When penetration of the punch 4 continues, the metal is nipped between the punch and the anvil and the deformation proceeds by drawing of the metal. By the action of the pressure and the friction being exerted upon the metal, the widened portion 14 is elongated until the cylindrical portion 43 of the punch has penetrated completely into the aperture, the plate then having the shape 15 of the pipe stub being sought. Of course during the course, of this operation, the thickness of the portion of the plate which constitutes the pipe stub diminishes. By this method, an elongation of about 250% is attained and the pipe stub obtained has a very adequate length for connection to a fluid circulation pipe under good conditions.

Of course, the above described operation must be carried out with care to avoid, in particular, tearing of the metal. The special shape of the punch has been given only diagrammatically and the various dimensions as well as the slopes of the surfaces and their radii of curvature should be determined preferably by dummy tests. A first shape will thus be obtained, which may, if necessary, be improved later on so as to obtain the reauired results without fail.

The embodiment which has just been described is applicable to walls in the form of segments of cylinders or to segments of spheres. It is possible to produce apertures in various positions, the wall being positioned, however, so that the axis of the aperture is vertical and coincides with the axis of the anvil. However, the position of the aperture is obviously restricted as a function of the angle of spread of the cylindrical segment or of the diameter at the base of the spherical segment so that in the position of penetration the upper edge 16 of the wall does not obstruct the movement of the punch 4.

Figure 4:
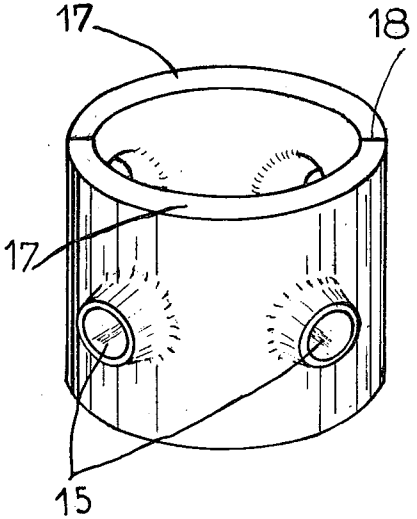
FIG. 4 shows an embodiment of a collar provided with pipe stubs in accordance with the invention.

In FIG. 4 there is shown by way of example a collar composed of a number of segments in which pipe stubs 15 have been produced in accordance with the above described method. This assembly is possible as far as the segments or "plastrons" 17 are assembled by straight welds which are relatively easy to produce and check.

However, when the angle of spread of the cylindrical segment is too great or it is required to make pipe stubs on closed collars the plant must be adapted to enable movement of the punch. In this case the apparatus illustrated in FIGS. 5 and 6 may be employed.

Figure 6:
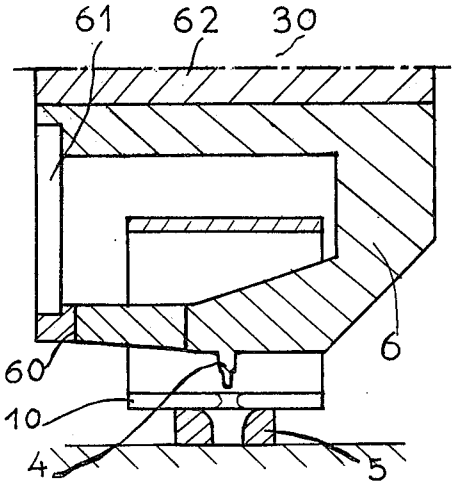
FIG. 5 and FIG. 6 show diagrammatically in transverse and axial section respectively an embodiment of apparatus according to the invention for use on a circular collar.

As may be seen in FIG. 6 the punch 4 is arranged at the bottom of an arm 6 cranked in the shape of a "hind's foot" so as to enter the collar 10, the top portion of the arm 6 bearing against the movable crossbar 30 of the press. The arm 6 thus transmits the vertical force from the press by passing around the collar 10 on one side and it is provided beyond the punch 4 with an extension 60 against a second arm 61 comes to bear. The arm 61 has the shape of a stay hinged on a bearer 62 on the arm 6. Thus, when the arm 61 is lowered the whole of the arm 6 and its extension 60, the arm 61 and the bearer 62 forms a semi-hyperstatic frame enabling the entire power of the press to be made to go through from the other side of the hidden face of the collar.

Figure 5:
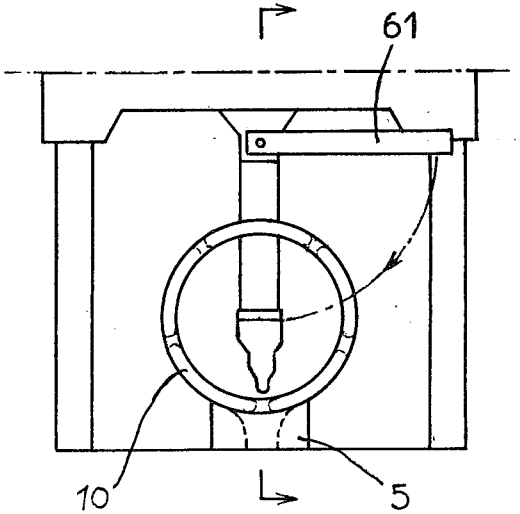

As shown in FIG. 5, the collar 10 is introduced into the force-transmitter frame by raising the arm 61. A number of apertures centered on the axes of the pipe stubs which are to be obtained have been produced beforehand by machining the collar. The collar is laid on the anvil 5 so that the axis of one of the apertures is vertical and coaxial with the tubular anvil. The arm 61 is lowered to come to bear against the extension 60 and the pipe stub is produced as has been described above with reference to FIG. 1. The punch is then raised and the collar turned about its axis to bring another aperture on to the axis of the anvil 5 and the operation restarted for the production of another pipe stub.

By this method and using the apparatus which have just been described, pipe stubs can be produced in walls of very great thickness, for example, more than 200 mm.

It has been seen that these pipe stubs could be produced in a collar in one piece or in walls curved and then assembled so as to form collars, and finally in segments of spheres. The walls may be of plate or of forged pieces.

The production of the part is easier because the prior machining of openings on to which prefabricated pipe stubs were to be fixed and welding, as well as the achieving of tricky welds, have been eliminated. Checking operations are reduced to a maximum extent during the course of manufacture and during the active life of the equipment, which checks were formerly necessitated precisely because of the difficulty of execution of welds, especially circular ones in thick sheet. The part from the metallurgical point of view is moreover more homogeneous and the elimination of welds enables stress-relieving treatments to be avoided which are generative of changes in the mechanical characteristics.

Of course the method and apparatus which have been described have other applications with certain adaptations. Thus, even if the axis of the pipe stub is generally normal to the wall it would be possible, by adapting the shape of the bearing surface 51 of the anvil, to achieve pipe stubs more or less inclined with respect to the wall.

In a general way the invention is not intended to be restricted to the details of the embodiments which have been described, but on the contrary include variants, especially those which differ from them only in the use of equivalent means.

What is claimed is:

1. A process of fabrication of a pipe stub from a wall of very great thickness constituting a portion of a chamber under pressure, said process comprising machining an aperture in the wall along an axis corresponding to the axis of the pipe stub to be obtained, the aperture having a diameter of the order of the thickness of the wall and being formed with rounded edges at the internal and external surfaces of the wall, placing the wall on a tubular anvil provided with a central conduit coaxial with the aperture and whose diameter corresponds substantially to the exterior diameter of the pipe stub to be obtained, the anvil being formed with an upper rounded surface whose diameter progressively increases up to a rounded bearing face whose shape corresponds to that of the wall at the juncture with said pipe stub, heating the wall at least in the region surrounding the aperture to a temperature greater than the transformation point A1 but less than the forging temperature, and deforming the wall by introducing a punch with force into the aperture, the punch having a first centering tip of diameter slightly less that of the aperture followed by a conical surface merging with said tip and widening in a direction away from the point and which is rounded in convex form and connects successively to a cylindrical portion whose diameter is substantially equal to the interior diameter of the pipe stub to be obtained, the introduction of the punch first centering the tip in the aperture and then progressively deforming the wall to form the pipe by progressive enlargement of the aperture by progressive penetration of the conical surface of the punch with concurrent diminution of the thickness of the sheet to form a deformed portion coming to be applied against the rounded surface of the anvil.

2. A method as claimed in claim 1, wherein said wall has the shape of a segment of a cylinder of revolution, said aperture is centered on a radial axis perpendicular to the axis of said cylinder and said wall is applied to said anvil with the axis of said aperture vertical, the angle of spread of said segment being restricted as a function of the position of said aperture such that in the position of penetration the upper edge of said wall does not obstruct the movement of said punch.

3. A method as claimed in claim 1, wherein said wall has the shape of a segment of a sphere, said aperture is centered upon an axis passing through the center of said segment, and said wall is applied to said anvil with the axis of said aperture vertical, the diameter at the base of said segment being restricted as a function of the position of said aperture such that in the position of penetration the upper edge of said wall does not obstruct the movement of said punch.

4. A method as claimed in claim 1, wherein said wall has the shape of a cylindrical collar, said aperture is centered on a radial axis perpendicular to the axis of said collar, said collar is applied to said anvil with the axis of said aperture vertical, said punch is arranged at the bottom of a cranked arm for transmission of the vertical forces, which arm extends into said collar from one side of said collar and on the other side of said collar a second movable bearer-arm for said punch is located, the whole forming a closed frame for transmission of the forces.

5. A method as claimed in claim 1, wherein said aperture is machined so as to have a cylindrical wall which is connected to the internal face and external face of said thick wall by convex rounded edges.

6. A method as claimed in claim 1, wherein said aperture is extended towards the inner face of said wall by a very much flattened conical dish the base of which has a diameter slightly less than that of the base of the pipe stub to be obtained, the conical surface of the dish being connected to the inner face of the wall and the cylindrical face of the aperture by convex rounded edges.

7. Apparatus for the manufacture of a pipe stub in a wall of very great thickness which constitutes part of a chamber to be placed under pressure, the apparatus comprising a press having a tubular anvil provided with a central passage, the diameter of which corresponds substantially with the outer diameter of the pipe stub to be obtained and the cross-section of which increases progressively up to a rounded bearing surface, the shape of which corresponds with that of the wall at the root of the pipe stub to be made, and a displaceable punch for entering an aperture preformed in the wall on the axis of the pipe stub, the cross-section of the punch increasing progressively up to a diameter at least equal to the internal diameter of the pipe stub, said punch comprising, starting from the end, a centering tip which is substantially cylindrical, a first conical surface merging with said cylindrical tip and increasing upwards, a substantially cylindrical portion of diameter substantially equal to the internal diameter of the pipe stub and a second conical surface increasing upwards, the conical surfaces and the cylindrical portions being connected by rounded connecting surfaces, the corresponding shapes of the punch and the anvil being such that first the centering tip penetrates in the aperture provided in the wall on which the pipe stub is to be formed, and then the aperture is progressively enlarged and the wall is progressively deformed around the aperture and comes to bear against the anvil.

* * * * *